US005664893A

United States Patent [19]

Meeussen et al.

[11] Patent Number: 5,664,893

[45] Date of Patent: Sep. 9, 1997

[54] THERMAL PRINTER COMPRISING A REAL TIME TEMPERATURE ESTIMATION

[75] Inventors: Dirk Meeussen, Bornem; Eric Kaerts, Melsele, both of Belgium

[73] Assignee: Agfa-Gevaert N.V., Mortsel, Belgium

[21] Appl. No.: 387,030

[22] Filed: Feb. 10, 1995

[30] Foreign Application Priority Data

Mar. 9, 1994 [EP] European Pat. Off. ..... 94200586

[51] Int. Cl.[6] ..... B41J 2/365

[52] U.S. Cl. ..... 400/120.14; 347/189

[58] Field of Search ..... 400/120.14; 347/189, 347/194

[56] References Cited

U.S. PATENT DOCUMENTS

| | | | |
|---|---|---|---|
| 3,577,137 | 5/1971 | Brennan et al. | 400/120.14 |
| 4,391,535 | 7/1983 | Palmer | 400/120.14 |
| 4,724,336 | 2/1988 | Ichikawa et al. | 347/194 |
| 4,912,486 | 3/1990 | Yumino | 347/194 |
| 5,066,961 | 11/1991 | Yamashita | 400/120.14 |
| 5,539,443 | 7/1996 | Mushika et al. | 347/194 |

*Primary Examiner*—John S. Hilten
*Assistant Examiner*—Steven S. Kelley
*Attorney, Agent, or Firm*—Brumbaugh, Graves, Donohue & Raymond

[57] ABSTRACT

A thermal sublimation printer comprises means for counting at periodic observation times the number ($N_h$) of activated heating elements; means for measuring at periodic observation times the temperature ($T_d$) of the drum and the temperature ($T_h$) of the heatsink; means for digitising the measured temperature of the drum and the measured temperature of the heatsink; means for transferring the number of activated heating elements and the digitised temperature values $T_d$ and $T_h$; a device for estimating the temperature ($T_e$) of the heating elements based on the values of $N_h$, $T_d$ and $T_h$; memory means for storing the estimate of the temperature of the heating elements; the printer operating to adjust the applied energy as a function of the estimate of the temperature of the heating elements and of the required temperature of the heating elements.

13 Claims, 8 Drawing Sheets

THERMAL PRINTER COMPRISING A REAL TIME TEMPERATURE ESTIMATION

DESCRIPTION

1. Field of the Invention

The present invention relates to thermal dye diffusion printing, further commonly referred to as thermal sublimation printing, and more particularly to a method for estimating the temperature of a heating element of a thermal head.

2. Background of the Invention

Thermal sublimation printing uses a dye transfer process, in which a carrier containing a dye is disposed between a receiver, such as a paper or a transparant, and a print head formed of a plurality of individual heat producing elements which will be referred to as heating elements. The receiver is mounted on a rotatable drum. The carrier and the receiver are generally moved relative to the print head, which is fixed. When a particular heating element is energised, it is heated and causes dye to transfer, e.g. by diffusion or sublimation, from the carrier to an image pixel in the receiver. The density of the printed dye is a function of the temperature of the heating element and the time the carrier is heated. In other words, the heat delivered from the heating element to the carrier causes dye to transfer to an image related to the amount of heat transferred to the carrier.

Thermal dye transfer printer apparatus offer the advantage of true "continuous tone" dye density transfer. By varying the heat applied by each heating element to the carrier, a variable density image pixel is formed in the receiver.

However, in systems utilising this type of thermal print head, it is observed that when heating elements having different temperatures are simultaneously and equally energised, the resulting image may show a nonuniform density.

Because the dye transfer process is highly temperature sensitive (in worst case the optical density changes with 0.03 D/°Centigrade), for a good tonal reproduction, it is of great importance to control the actual temperature of the heating elements. A first patent of interest for its teaching is U.S. Pat. No. 4,391,535 entitled "Method and apparatus for controlling the area of a thermal print medium that is exposed by a thermal printer" by R. Palmer. The system of that patent provides a method which estimates the actual temperature of the thermal print element.

Another patent of interest is U.S. Pat. No. 5,066,691, entitled "Tonal printer utilizing heat prediction and temperature detection means" by H. Yamashita. This patent discloses that a thin film thermal head involves a first dominant heat accumulation in the head mount determined from the thermal capacity of the head mount and its heat dispersing resistance to the ambient, a second heat accumulation in the heating element substrate, and a third heat accumulation in the heating elements themselves, and that they have distinct thermal time constants in the order of several minutes, several seconds and several milliseconds, respectively.

None of the foregoing prior art techniques considers the heat accumulation in the drum, and so none of them is capable of performing an accurate estimate for the temperature ($T_e$) of the heating elements.

Moreover, none of the foregoing prior art techniques provides a method which permits a fast estimate for the temperature $T_e$ of the heating elements to be adjusted in real time for variations in said temperature.

From the foregoing, it can be seen that estimate of the temperature of the heating elements in thermal printers is a problem that has been approached in several ways. The present invention is directed towards an improved solution to that problem.

OBJECTS OF THE INVENTION

It is an object of the present invention to provide a thermal printing system comprising an accurate estimate for the temperature of the thermal print element.

It is a further object of the present invention to provide an improved method to accurately estimate the temperature of the thermal print element.

Further objects and advantages will become apparant from the description given hereinbelow.

SUMMARY OF THE INVENTION

We now have found that the above objects can be achieved by providing a thermal printing system including a printer which uses a dye donor member having one or more dye frames and an acceptor member on a receiving sheet secured to a rotatable printing drum, which acceptor receives dyes from said dye frames; said printer including a thermal head having at least a plurality of heating elements, a heating element substrate and a heatsink mount; first controlling means for driving synchronised movements of the donor member and the acceptor member along respective paths relative to the thermal head such that as the thermal head is activated in accordance with image data, dye from a dye frame is transferred to the receiver to form an image thereon; second controlling means for supplying line by line an activating signal corresponding to the image data to activate the heating elements; means for counting at periodic observation times the number ($N_h$) of activated heating elements; means for measuring at periodic observation times the temperature ($T_d$) of the drum and the temperature ($T_h$) of the heatsink; means for digitising the measured temperature ($T_d$) of the drum and the measured temperature ($T_h$) of the heatsink; means for transferring the number ($N_h$) of activated heating elements and the digitised temperature values $T_d$ and $T_h$; a device for estimating the temperature ($T_e$) of the heating elements based on the values of $N_h$, $T_d$ and $T_h$; memory means for storing the estimate of the temperature ($T_e$) of the heating elements; said printer operating to adjust the applied energy to said heating elements of said thermal head as a function of said estimate of the temperature of the heating elements and of the required temperature of the heating elements.

DETAILED DESCRIPTION OF THE INVENTION

Hereinbelow the present invention will be clarified in detail with reference to the attached drawings, without the intention to limit the invention thereto:

Figure 1:
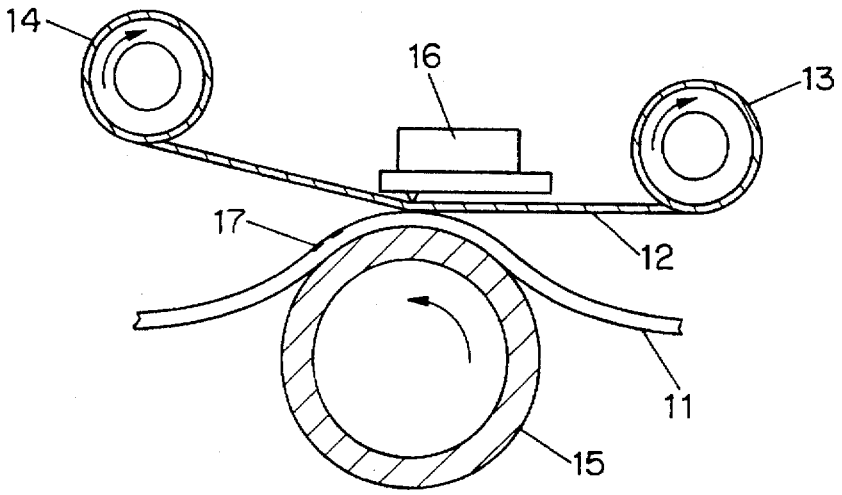
FIG. 1 is a principal scheme of a thermal sublimation printer.

Referring to FIG. 1, there is shown a global principe scheme of a thermal printing apparatus that can be used in accordance with the present invention and which is capable to print a line of pixels at a time on a receiver or acceptor member 11 from dyes transferred from a carrier or dye donor member 12. The receiver 11 is in the form of a sheet; the carrier 12 is in the form of a web and is driven from a supply roller 13 onto a take up roller 14. The receiver 11 is secured to a rotatable drum or platen 15, driven by a drive mechanism (not shown) which continuously advances the drum 15 and the receiver sheet 11 past a stationary thermal head 16. This head 16 presses the carrier 12 against the receiver 11 and receives the output of the driver circuits. The thermal head 16 normally includes a plurality of heating elements (further indicated by $N_e$) equal in number to the number of pixels in the image data present in a line memory. The imagewise heating of the dye donor element is performed on a line by line basis, with the heating resistors geometrically juxtaposed each along another and with gradual construction of the output density. Each of these resistors is capable of being energised by heating pulses, the energy of which is controlled in accordance with the required density of the corresponding picture element. As the image input data have a higher value, the output energy increases and so the optical density of the hardcopy image 17 on the receiving sheet. On the contrary, image data with a lower value cause the heating energy to be decreased, giving a lighter picture 17.

Figure 3:
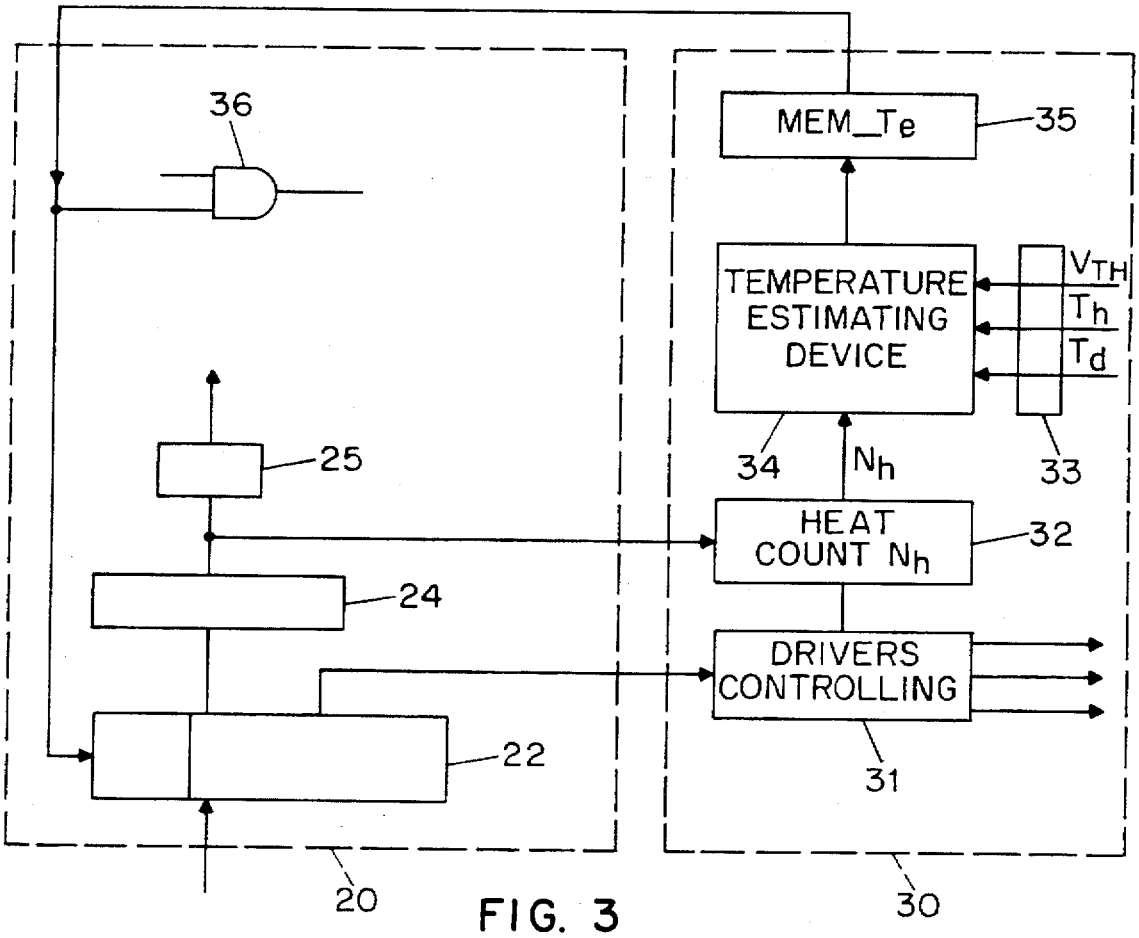
FIG. 3 is a second block diagram of an activation of the heating elements in connection with a temperature estimating according to the present invention.
Figure 2:
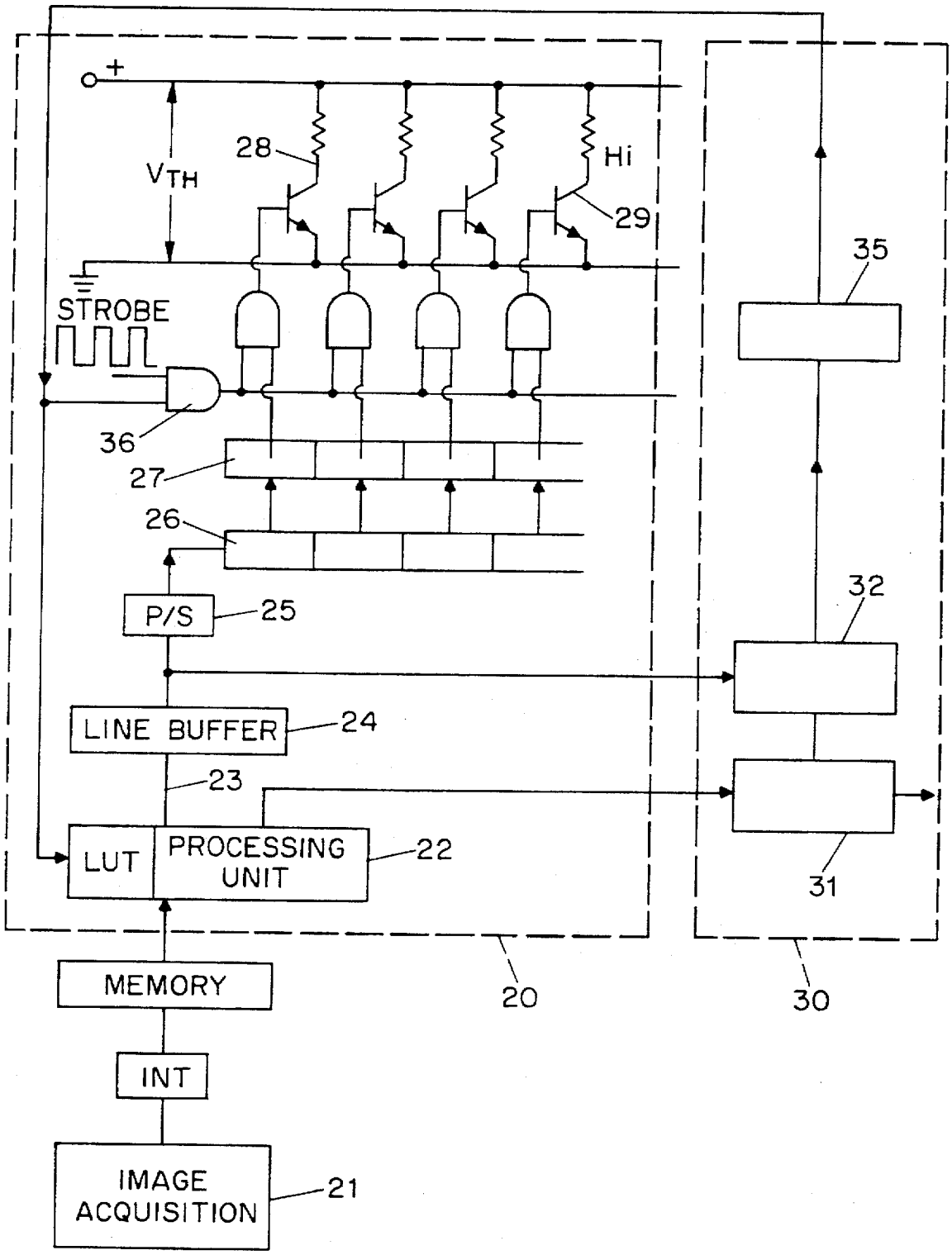
FIG. 2 is a first block diagram of the activation of the heating elements.
Figure 16:
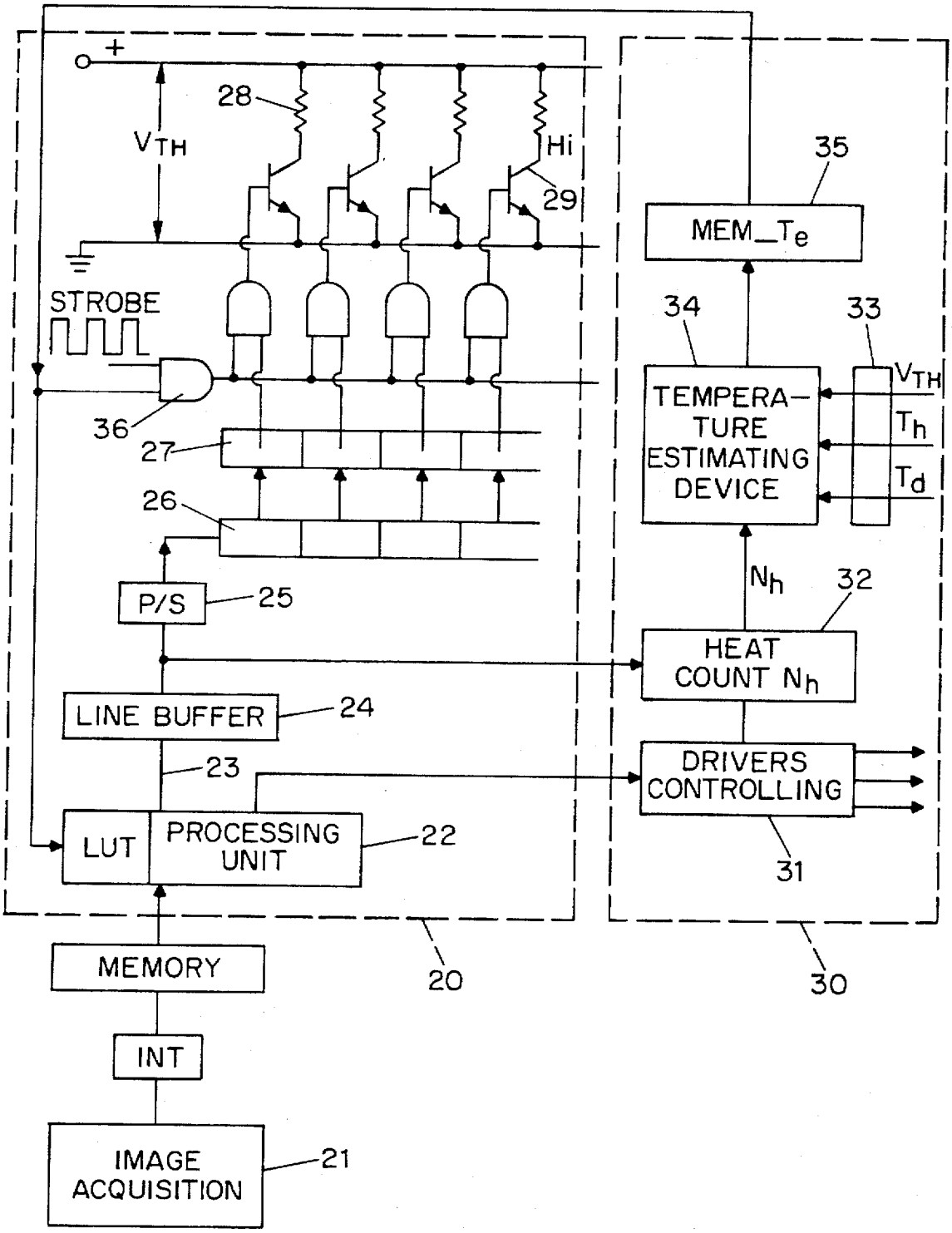
FIG. 16 is a global block diagram of an activation of the heating elements in connection with a temperature estimating according to the present invention.

In the present invention, the activation of the heating elements is preferably executed pulsewise and preferably by digital electronics. FIG. 2 is a first block diagram of the activation of the heating elements; FIG. 3 is a second block diagram of said activation in connection with a temperature estimating according to the present invention; FIG. 16 is is a global block diagram of an activation of the heating elements in connection with a temperature estimating according to the present invention.

First a digital signal representation is obtained in an image acquisition apparatus 21. Then, the image signal is applied via a digital interface (indicated as INT in FIG. 2) and a first storing means (indicated as MEMORY in FIG. 2) to a recording unit 20 of a thermal sublimation printer. In the recording unit 20 the digital image signal is first processed in a processing unit 22. Next the recording head is controlled so as to produce in each pixel the density value corresponding with the value of the processed digital image signal 23. After processing (in 22) and buffering (in 24) and parallel to serial conversion (in 25) of the digital image signals, a stream of serial data of bits is shifted into another storing means, e.g. a shift register 26, representing the next line of data that is to be printed. Thereafter, under controlled conditions, these bits are supplied in parallel to the associated inputs of a latch register 27. Once the bits of data from the shift register 26 are stored in the latch register 27, another line of bits can be sequentially clocked into said shift register 26. As to the heating elements 28, the upper terminals are connected to a positive voltage source (indicated as $V_{TH}$ in FIGS. 2 and 16), while the lower terminals of the elements are respectively connected to the collectors of the driver transistors 29, whose emitters are grounded. These transistors 29 are selectively turned on by a high state signal (indicated as STROBE in FIGS. 2 and 16) applied to their bases and allow current to flow through their associated heating elements 28. In this way a thermal sublimation hardcopy of the electrical image data is recorded.

Because the temperature estimating is very important for the further disclosure of the present invention, special attention is now focused on it. In FIG. 3 is schematically illustrated a temperature estimating unit 30 according to the present invention and comprising a drivers controlling means 31 for driving the synchronised movements of the donor and the acceptor member; a means 32 for counting the number ($N_h$) of activated heating elements; means for transferring the number ($N_h$) of activated heating elements; means 33 for measuring the temperature ($T_d$) of the drum and the temperature ($T_h$) of the heatsink and for digitising the measured temperature ($T_d$) of the drum and the temperature ($T_h$) of the heatsink; means for transferring the digitised temperature values $T_d$ and $T_h$; a digital device 34 for estimating the temperature ($T_e$) of the heating elements; a memory means 35 (MEM_$T_e$) for storing the temperature of a heating element; a controlling means 36 for supplying a driving signal corresponding to the input image to activate the heating elements.

In order to acquire a general overview of the resulting activation, reference is made to FIG. 16. The identified structural elements of FIG. 16 are similar in structure and in operation to those of the correspondingly numbered structural elements described in relation to the FIGS. 2 and 3, and, hence, require no further description.

Now, according to the present invention, provided is a thermal printing system including a printer which uses a dye donor member having one or more dye frames and an acceptor member on a receiving sheet secured to a rotatable printing drum, which acceptor receives dyes from said dye frames; said printer including a thermal head having at least a plurality of heating elements, a heating element substrate and a heatsink mount; first controlling means for driving the synchronised movements of the donor member and the acceptor member along respective paths relative to the thermal head such that as the thermal head is activated in accordance with image data, dye from a dye frame is transferred to the receiver to form an image thereon; second controlling means for supplying line by line an activating signal corresponding to the image data to activate the heating elements; means for counting at periodic observation times the number ($N_h$) of activated heating elements; means for measuring at periodic observation times the temperature ($T_d$) of the drum and the temperature ($T_h$) of the heatsink; means for digitising the measured temperature ($T_d$)

of the drum and the measured temperature ($T_h$) of the heatsink; means for transferring the number ($N_h$) of activated heating elements and the digitised temperature values $T_d$ and $T_h$; a device for estimating the temperature ($T_e$) of the heating elements based on the values of $N_h$, $T_d$ and $T_h$; memory means MEM_Te for storing the estimate of the temperature ($T_e$) of the heating elements; said printer operating to adjust the applied energy to said heating elements of said thermal head as a function of said estimate of the temperature of the heating elements and of the required temperature of the heating elements.

In a preferred embodiment of a thermal printing system according to the present invention, said means for counting at periodic observation times the number ($N_h$) of activated heating elements and said means for transferring the number ($N_h$) of activated heating elements and the digitised temperature values $T_d$ and $T_h$ are operating, respectively counting and transferring, within periodic observation times which are not longer than the time necessary to print a line on the acceptor member.

Figure 4:
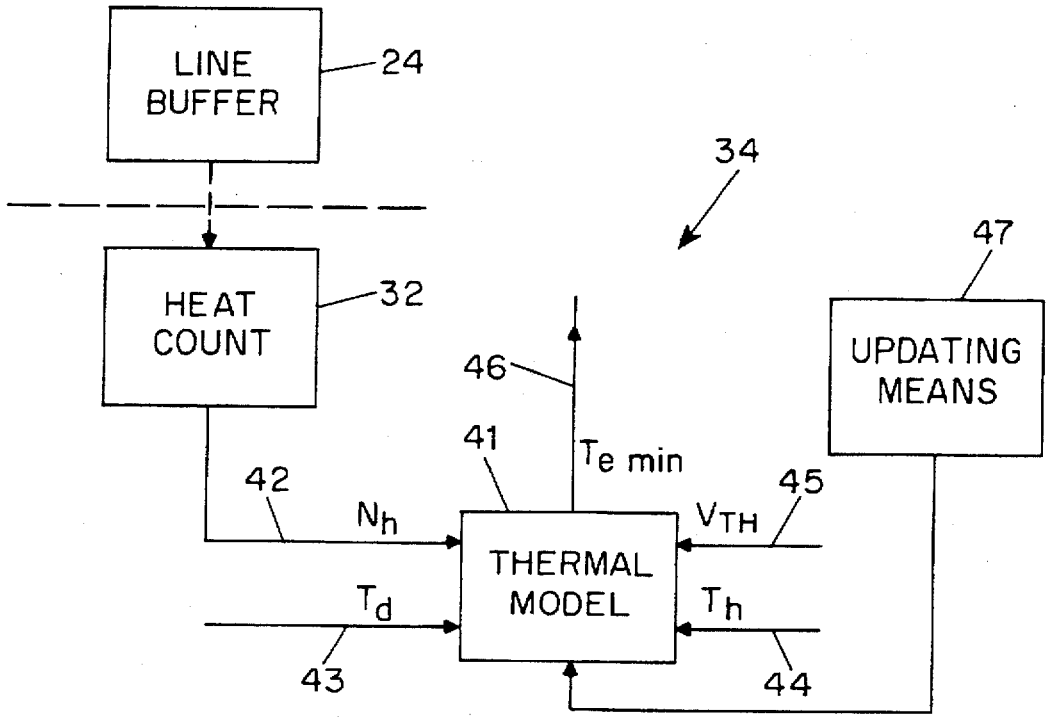
FIG. 4 is a principal scheme of a temperature estimating device according to the present invention.

In FIG. 4 a principal scheme of a temperature estimating device 34 according to the present invention for estimating the temperature ($T_e$) of the heating elements is figurated separately. It mainly comprises a thermal model 41 (which will be described further on with reference to the later FIG. 10); a means 32 for counting the number ($N_h$) of activated heating elements; a means 42 for transferring the number ($N_h$) of activated heating elements; means 43 and 44 for capturing the digitised values of the temperature ($T_d$) of the drum and the temperature ($T_h$) of the heatsink; means 45 for capturing and digitising the voltage $V_{TH}$ supplied to the thermal head; initialisation or updating means (47) for setting the thermal characteristics of the thermal head and of the consumables, for setting a value for the power ($P_e$) received from a power supply into a heating element and for setting an initial value ($T_{s0}$) for the temperature ($T_s$) of the substrate; and an outgoing estimate 46 of the temperature $T_e$. All these mentioned components of the estimating device 34 will be described separately in the further description.

Figure 5:
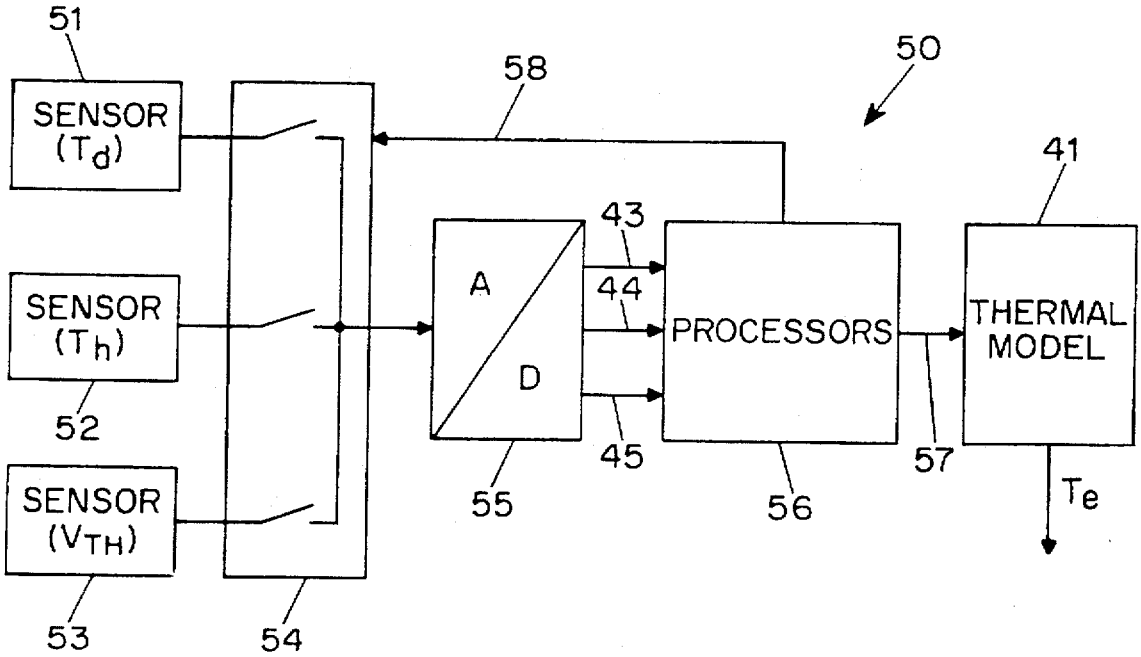
FIG. 5 is a preferred embodiment of a multiplexing device according to the present invention.

FIG. 5 shows more in detail a preferred embodiment of a multiplexing device 50 according to the present invention as used in connection with the just described temperature estimating device 34 (cfr. FIGS. 3 and 4). Multiplexing device 50 preferably comprises a means 51 for measuring the temperature ($T_d$) of the drum, a means 52 for measuring the temperature ($T_h$) of the heatsink, means 53 for capturing the voltage $V_{TH}$ supplied to the thermal head, a multiplexer 54, an analogue to digital convertor 55, one or more processors 56, and means for transferring all signals. This at least one processor 56 has two kinds of outgoing signals, first transferring scaled signals 57 for $T_d$, $T_h$ and $V_{TH}$, and second a feedback signal 58 which controls the multiplexer 54 in order to pass sequentially the correct signals $T_d$ from 51, $T_h$ from 52 and $V_{TH}$ from 53. It is noticed that in the present application, as well the analogue signals as well as the digitised (either unscaled or rescaled) values of a thermal characteristic, have the same alphabetic symbol; e.g. $T_d$ reflects as well the analogue signal of the temperature of the printing drum (with a specific numeric referal 51) as well as the digitised but unscaled value of the temperature of the printing drum (with a specific numeric referal 43) as well as the digitised but rescaled value of the temperature of the printing drum (with a common numeric referal 57 or with a specific numeric referal 57–43).

Figure 6:
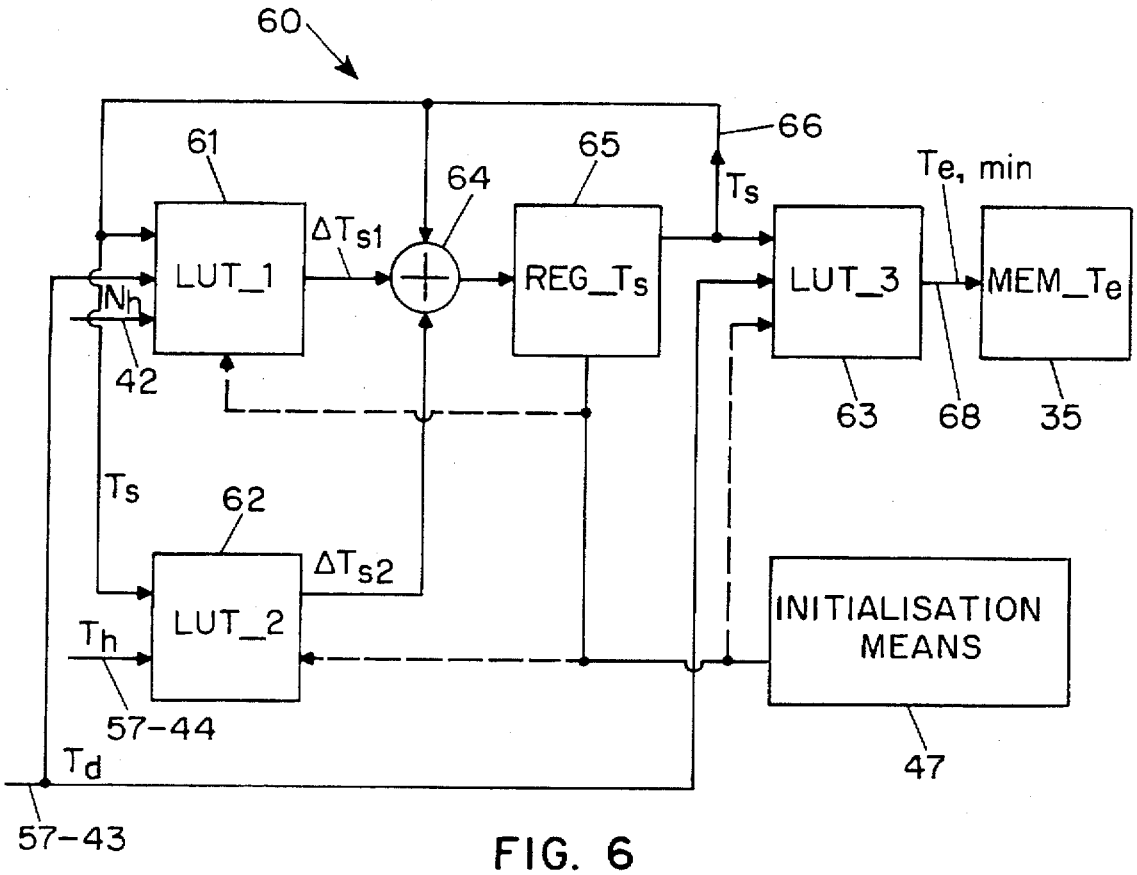
FIG. 6 is a preferred embodiment of a temperature estimating device according to the present invention.

Whereas hereabove a principal scheme of a temperature estimating device (indicated by referral 34) has been given, FIG. 6 now shows more in detail a further preferred embodiment of a temperature estimating device 60 according to the present invention, comprising LUT's (or "look up tables") for using the thermal model. It is stated that the thermal model itself was already indicated by referal 41 in FIGS. 4 and 5, and that the temperature LUT's may be implemented e.g. in an EEPROM or in a RAM device. This embodiment comprises a first look up table or LUT 61 (also indicated as LUT_1), a second LUT 62 (also indicated as LUT_2), a third LUT 63 (also indicated as LUT_3), an adding means 64, a register memory 65 (indicated as REG_$T_s$) and the necessary means for transferring all signals. The inputs of LUT_1 are the digitised values (cfr. FIG. 5) of $T_d$, $T_s$ and $N_h$; the inputs of LUT_2 are $T_s$ and $T_h$; the inputs of LUT_3 are $T_s$ and $T_d$. An initialisation means 47 serves for setting an initial value for the temperature of the substrate in the register 65, and for initialisation of the abovementioned temperature LUT's in case these are implemented in a RAM device. At the end, the working of the preferred embodiment of FIG. 6 results in an output estimate 68 of $T_e$, or more precisely $T_{e,min}$ which is fed to a memory MEM_$T_e$ (illustrated by referal 35 in FIGS. 3 and 6). (The term $T_{e,min}$ will be explained later on with reference to FIG. 14 and comprises the temperature of the heating elements just before a printing line is started, further indicated as "the minimum temperature".)

Accordingly, in a further preferred embodiment of the present invention, a printer is disclosed wherein said device for estimating the minimum temperature ($T_{e,min}$) of the heating elements comprises: initialisation means (47) for setting an initial value ($T_{s0}$) for the temperature ($T_s$) of the substrate; a first LUT-table (61) for storing a first relation representing a first change ($\Delta T_{s1}$) in the temperature of the substrate as a function of the temperature values $T_d$ and $T_s$ and of the number ($N_h$) of activated heating elements; a second LUT-table (62) for storing a second relation representing a second change ($\Delta T_{s2}$) in the temperature of the substrate as a function of the temperature values $T_s$ and $T_h$; adding means (64) for adding said first change ($\Delta T_{s1}$) and said second change ($\Delta T_{s2}$) in the temperature of the substrate and the foregoing value ($T_{so}$) of the temperature of the substrate as it was estimated during the preceding line; a register means (65) for temporary storing the adding result ($T_s$); a feedback circuit (66) for feeding back the adding result ($T_s$) to an input of said first LUT-table and to an input of said second LUT-table; a third LUT-table (63) for storing a third relation representing the minimum temperature of the heating elements ($T_{e,min}$) of a thermal head as a function of the temperature values $T_s$ and $T_d$; means (50) for periodically updating the contents of all above mentioned means.

In order to explain the working of the preferred embodiment of FIG. 6, the basic equivalent model has to be described. This may start by first taking a closer look on FIG. 7, which is a detailed cross section of a thermal head, indicated as part 16 in FIG. 1 and containing a heatsink mount 71, a temperature sensor 72, a bonding layer 73, a ceramic substrate 74, a glazen bulb 75, a heating element 76 and a wear resistant layer 77.

Figure 7:
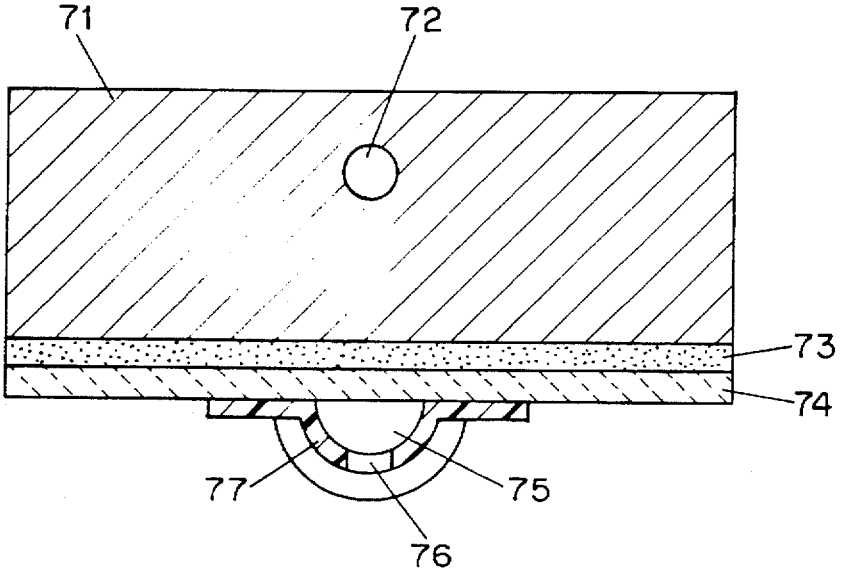
FIG. 7 is a cross section of a thermal head.
Figure 8:
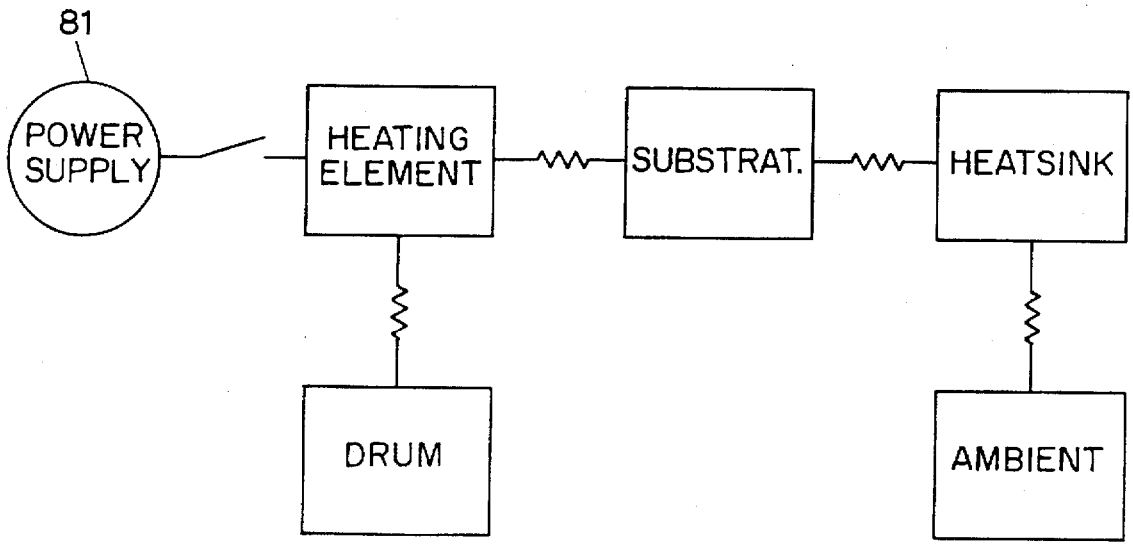
FIG. 8 is a thermal model of the structure of a thermal head.

FIG. 8 illustrates a thermal model of the structure of FIGS. 1 and 7, which thermal model includes schematic representations of the respective thermal masses of a heating element 76, substrate 74 and heatsink 71 and of the printing drum 15. It can be seen that the power received from a power supply 81 into a heating element 76 produces heat that is conducted through the thermal mass of said heating element. The heat may further be conducted through the consumables to the drum 15 and through the thermal resistance between heating element 76 and substrate 74 to the thermal mass of said substrate. The heat conducted through the thermal mass of substrate 74 is conducted through the thermal resistance between substrate 74 and heatsink 71 to the thermal mass of said heatsink. The heat conducted through the thermal mass of heatsink 71 is then lost to the ambient.

During printing the heat flows from the individual heating elements to the substrate, causing locally heat accumulation in the substrate. Because of the high thermal resistance from element to substrate (cfr. glazen bulb 75) and the low thermal resistance of the substrate itself, the substrate temperature can be considered as being uniform. However, an accurate measurement of the substrate temperature is difficult to realise because of the need for a fast temperature sensor, and the inaccessibility of the substrate surface. Therefore the substrate temperature, during printing, is calculated by means of an equivalent model of the print head, of the consumables and of the drum.

Given the thermal model of FIG. 8, an equivalent electrical model can be developed, the basics of which are first shortly introduced using a socalled "lumped capacitance model". It is a preferred model for solving transient heat-conduction problems and has been addressed in a book by Incropero and DeWitt, entitled "Fundamentals of heat and mass transfer", third edition John Wiley & sons, page 226 etc. For example, if the surface temperature of a system is altered, the temperature at each point in the system will also change and this change will continue to occur until a steady state temperature is reached. Now, the essence of the lumped capacitance method is the assumption that the temperature of a solid is spatially uniform at any instant during the transient process, which thus implies that temperature gradients within the solid are negligible. Heat conduction in the absence of a temperature gradient implies the existence of infinite thermal conductivity, which condition is clearly impossible. However, although the condition is never satisfied exactly, it is closely approximated if the resistance to conduction within the solid is small compared with the resistance to heat transfer between the solid and its surroundings and as it is assumed that the donor ribbon, the acceptor sheet and the print line on the drum have a uniform and equal temperature.

In neglecting temperature gradients within the solid, the transient temperature response is determined by formulating an overall energy balance on the solid. This balance relates the rate of heat generated by activation to the rate of heat loss. The corresponding changes in temperatures generally progress exponentially. During activation by an external power supply 81, the thermal head is first charged to a temperature $\theta_i$. When the power supply is withdrawn, the energy stored in the solid is discharged and the temperature of the solid decays with time. This behaviour may be interpreted as a thermal time constant $\tau$ and expressed as $\tau=R\,C$ where R is the resistance to heat transfer and C is the thermal capacitance of the solid. Any increase in R or C will cause a solid to respond more slowly to changes in its thermal environment and will increase the time required to reach thermal equilibrium ($\Delta\theta=0$).

Figure 9:
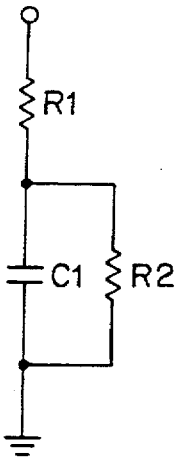
FIG. 9 is a basic cell of an equivalent circuit for a thermal head.

Given the thermal model of FIG. 8 and after having explained the principe of a lumped capacitance model, now a basic cell of a thermal equivalent circuit for a thermal head can be developed. From this point of view, it is useful to note that RC electrical circuits may be used to determine the transient behavior of thermal systems. FIG. 9, which is still incomplete but didactically sufficient for a clear introduction, shows such a basic cell of a thermal equivalent circuit, in which a thermal resistance $R_1$ and a thermal capacitor $C_1$ are connected in series and a thermal resistance $R_2$ is connected in parallel with both ends of capacitor $C_1$. Because the above mentioned thermal behaviour is analogous to the voltage decay that occurs when a capacitor is discharged through a resistor in an electrical RC circuit, the voltage $V_1$ over the capacitor in a charging cycle and the voltage $V_2$ over the capacitor in a discharging cycle are calculated as follows:

$$V_1=V_{10}\times(1-e^{-\alpha t}) \quad [1]$$

$$V_2=V_{20}\times e^{-\alpha t} \quad [2]$$

where $V_{10}$ and $V_{20}$ are initial values, and wherein $$\alpha=(R_1+R_2)/(R_1R_2C).$$

Given the above mentioned thermal model shown in FIG. 8 and given the basic elements of an equivalent electrical model shown in FIG. 9, now an appropriate global equivalent electrical model can be constructed. As the inventors of the present application discovered that, of the total amount of heat produced, about 20% to 30% will pass the consumables and/or the drum, and that 80% to 70% is lost via the heatsink, also the thermal resistance $R_{ed}$ is essentially incorporated in the equivalent model.

Since the heatsink temperature $T_h$ can be measured at an appreciable accuracy with a temperature detection means such as a thermister 72 attached to the heatsink 71, and since it is relatively easy to measure directly the temperature of the drum, it is of great advantage to predict the heating element substrate temperature $T_s$ with reference to the measured temperature value $T_h$ of the heatsink in addition to the initial value of each temperature and the application energy $P_e$. The electrical model in FIG. 10 may be approximated as illustrated. A first temperature sensor (cfr. also ref. 51 in FIG. 5) is provided for measuring the drum temperature $T_d$ and correlates with an equivalent voltage $V_d$. Likewise, a second temperature sensor is provided for measuring the temperature $T_h$ of heatsink 71 and provides a voltage $V_h$. An output current from a current source is coupled to a first side of capacitance $C_e$ whose second side is connected to ground or reference potential. First sides of resistances $R_{ed}$ and $R_{es}$ are connected to the first side of capitance $C_e$. A second side of resistances $R_{es}$ is connected to the first side of each of capacitance $C_s$ and a resistance $R_{sh}$. A second side of resistance $R_{ed}$ is connected to the first side of the printing drum.

Figure 10:
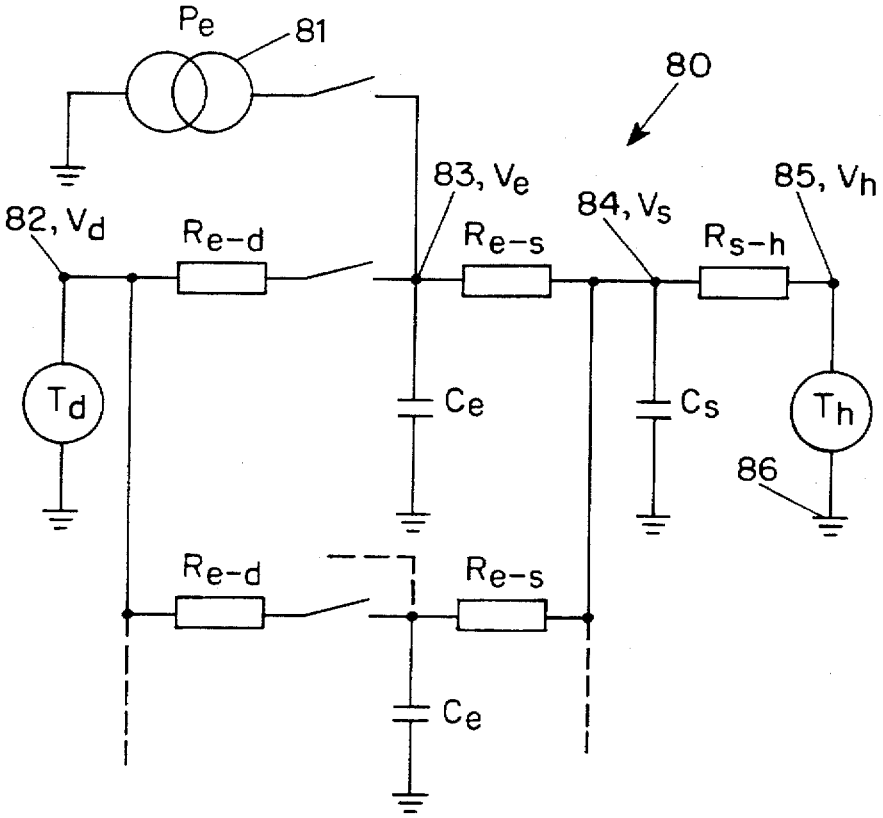
FIG. 10 is a global equivalent model according to the present invention for a thermal head.

From a comparison of FIGS. 8 and 10, it will be recognised that the components in FIG. 10 are the electrical equivalents of the thermal elements in FIG. 8. In FIG. 10, references C and R denote the thermal characteristics of the heating element 76, the substrate 74 and heatsink 71 respectively. More in detail, $C_e$ is the thermal mass of heating element 76, $C_s$ is the thermal mass of substrate 74, $R_{ed}$ is the thermal resistance between the heating element 76 and the printing drum 15, $R_{es}$ is the thermal resistance between the heating element 76 and the substrate 74 through the glazen layer 75, $R_{sh}$ is the thermal resistance between the substrate 74 and the heatsink 71, $P_e$ is the electric power applied to the whole head, $T_d$ is the temperature of the drum.

Herein, $V_d$ (ref 82) stands for the measured temperature of drum 15. The second side of the printing drum is connected to ground or reference potential. A voltage $V_e$ (ref 83) appears at the common junction of capacitance $C_e$, resistance $R_{ed}$ and resistance $R_{es}$, and is equivalent to the estimated temperature of a heating element 76. A voltage $V_s$ (ref 84) is supplied to the common junction of resistances $R_{es}$ and $R_{sh}$, being equivalent to the estimated temperature of substrate 74. A voltage $V_h$ (ref 85) appears at resistance $R_{sh}$ and is equivalent to the measured temperature of heatsink 71.

Provided that the component values are appropriately chosen and that the voltages supplied to the electrical model (e.g. voltages $V_d$ and $V_h$) are appropriately scaled, it can be seen that the voltage $V_e$ in FIG. 10 will be an accurate estimation of the temperature of heating element 76, which estimation can be used to precisely control the heating of the thermal printer.

The simplified electrical model of FIG. 10, incorporated in FIG. 6, further may be used by a practical circuit which functions to control the heating in accordance with the estimated heating element temperature $T_e$, or the equivalent voltage $V_e$.

For sake of greater clarity of the equivalent thermal model, some numerical examples are given hereinbelow,_ wherein W stands for Watt, PJ for Joule, °C. for degrees centigrade_, without being restrictive as to the scope of the present invention: e.g. $P_e$≈0,065 W; $C_e$=1,17×10$^{-6}$ J/°C.; $R_{es}$=2703° C./W; $R_{ed}$ 6500° C./W; $C_s$=221 J/°C.; $R_{sh}$=0, 008° C./W; Vh≈45° C.; Vd≈30° C.

Accordingly, another embodiment of the present invention provides a method for printing an image using a printing system as described hereabove, comprising a step of estimating the minimum temperature ($T_{e,min}$) of the heating elements of a thermal head based on an equivalent electrical model (80) for the heat transfer relationship between said heating elements and the surrounding environment, said model being represented by an electrical scheme _indicated as "lumped capacitance scheme"_, comprising electrical capacitors and electrical resistors, representing respectively thermal capacities and thermal resistances of said heating elements, of said substrate, of said heatsink mount, of the ambient air and of the printing drum, and taking into account the heat lost in said drum and in said donor member and/or in said acceptor member; and wherein said model is periodically updated in discrete steps.

According to the present invention, the method for estimating the temperature of a heating element estimates the amount of heat stored in thermal head after an activating strobepulse is supplied to said thermal head and, more specifically, estimates how much heat will remain stored in thermal head at the time of the next printing. [In order to eliminate any possible confusion of thoughts, the physical relation between the distinctive terms "temperature" and "heat value", will be explained further on, in the paragraphs concerning formula 5.] The estimated heat value is stored in a memory at each printing cycle; said memory thus contains a thermal history of the thermal head.

Next, in a further preferred embodiment of the present invention, the temperature ($T_s$) of said substrate is obtained by measuring the temperatures of the drum ($T_d$) and of the heatsink ($T_h$), and adding, at periodic observation times, the temperature changes in the substrate ($\Delta T_s$) as calculated from the difference between (first) the total heat generated by all activated heating elements and cumulatively stored in the thermal head during the sequential heating times and (second) the total heat lost during said observation times as a consequence of the energy unloaded from the substrate to the heatsink and to the drum.

Figure 11:
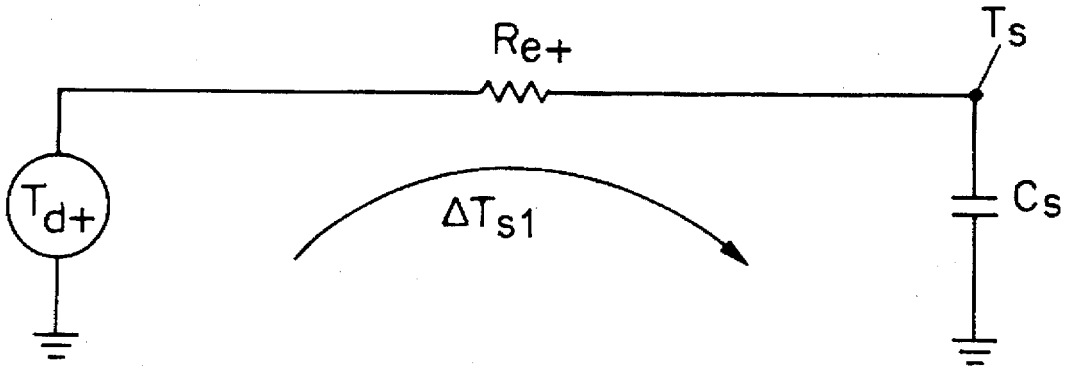
FIG. 11 is an equivalent scheme for the updating step of warming up the substrate by activating the heating elements.
Figure 12:
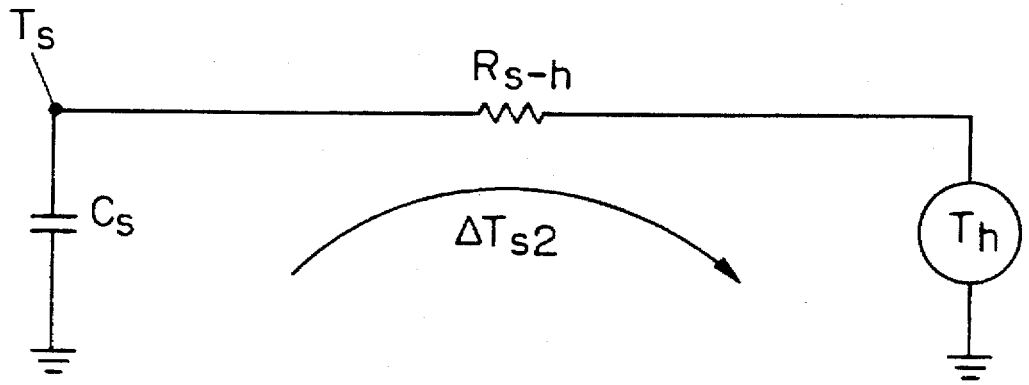
FIG. 12 is an equivalent scheme for the updating step of cooling down the substrate by contact with the heatsink mount.
Figure 13:
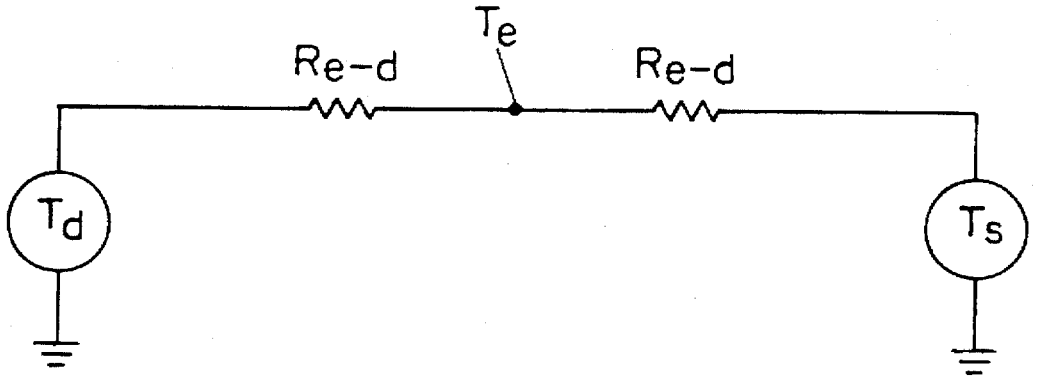
FIG. 13 is an equivalent scheme for the updating step of retrieving the temperature value Te as resulting from the temperature values Td and Ts.

All these heat estimates are obtained by using the model of FIG. 10, the working of which will now be explained in discrete sequential steps, with reference to the FIGS. 11, 12 and 13. Herein, FIG. 11 is an equivalent scheme for the (updating) step of warming up the substrate by activating the heating elements; FIG. 12 is an equivalent scheme for the (updating) step of cooling down the substrate by contact with the heatsink mount; FIG. 13 is an equivalent scheme for the updating step of retrieving $T_e$ as resulting from $T_d$ and $T_s$.

Initially, before starting the first printing cycle of an image, the method of the present invention starts with a measurement of the temperature of the heatsink ($T_{h0}$) and a measurement of the temperature of whether the ambient air, or preferably the temperature of the drum ($T_d$). Indeed, the temperature of the heatsink and of the drum change slow enough, so that they can be measured easily.

Once the printing apparatus has already been printing (for at least one linetime), every next printing cycle starts by retrieving the temperatures $T_d$, captured via a multiplexer (FIG. 5), and $T_s$, acquired from a foregoing cycle and stored in a storing means REG_$T_s$ (see referal 65 in FIG. 6), and by feeding them to a LUT_1 (see FIG. 6).

By using the measured temperatures and the amount of heat remaining from foregoing printing cycles and stored in a memory, the method of the present invention estimates the amount of heat stored at the beginning of the next printing cycle.

Further, the substrate temperature ($T_s$) is obtained at periodic observation times, by adding the temperature changes in the substrate ($\Delta T_s$) as calculated from the difference between (first) the total heat generated by all activated heating elements and cumulatively stored in the thermal head during the sequential strobe times (abreviated as $t_{son}$ and indicated in the later FIG. 15) and the heat lost to the drum, and (second) the total heat lost during said observation time. Herein, according to the present invention, the evolutions over time of said total heat generated and of said total heat lost are preferably approximated linearly.

A first step in the estimating of the temperature changes in the substrate ($\Delta T_s$) comprises the calculation of the rise of the substrate temperature ($\Delta T_{s1}$) as a consequence of the energy generated by the heating elements, and relates to FIG. 11, which is an equivalent scheme for the (updating) step of warming up the substrate by activating the heating elements. In this context, the thermal resistance $R_+$ amounts to $R_+=(R_{ed}+R_{es})/N_e$ When the printing head is in contact with the printing drum, formula [3] applies to the drum $$T_{d+}=T_d+(N_h/N_e)\cdot P_e\cdot R_{ed} \quad [3]$$

In order of a good understanding, it is stated that a computing circuit may estimate a temperature on a thermal head by dividing the estimated heat quantity by the thermal capacity of said thermal head. Indeed, in electricity the formulae [4 & 5] are well known $$\Delta V=\Delta Q/C \quad [4]$$

wherein $$\Delta Q=i\cdot\Delta t \quad [5]$$

so that by equivalence, knowing also the analogy that an electrical voltage V corresponds thermally to a temperature T and supposing that for small time intervalls Δt the intrinsically exponential evolution over time may be approximated by a linear evolution, formula [6] applies to FIG. 11

$$\Delta T_{s1} = \left( T_{d+} + \frac{N_h}{N_e} \cdot P_e \cdot R_{ed} - T_s \right) \cdot \frac{\Delta t}{R_{e+}} \cdot \frac{1}{C_s}$$

$$\Delta T_{s1} = \left( T_{d+} + \frac{N_h}{N_e} \cdot P_e \cdot R_{ed} - T_s \right) \cdot \frac{\Delta t}{(R_{ed} + R_{es})/N_e} \cdot \frac{1}{C_s} \quad [6]$$

For sake of greater convenience, said formula [6] is incorporated in LUT_1 (see FIG. 6).

The second step calculates at the end of every observation period, preferably every linetime, the decay of the substrate temperature ($\Delta T_{s2}$) as a consequence of the energy unloaded from the substrate to the heatsink. Reference can be made to FIG. 12 which is an equivalent circuit for the (updating) step of cooling down the substrate by physical contact with the heatsink mount. Herefrom, and again supposing that for small time intervalls $\Delta t$ the intrinsically exponential evolution over time may be approximated by a linear evolution, it results that unloading the substrate applies according to formula [7], which is preferably implemented in LUT_2 (see FIG. 6):

$$\Delta T_{s2} = (T_s - T_h) \cdot \frac{\Delta t}{R_{sh} \cdot C_s} \quad [7]$$

The third step of the present invention calculates (algebraically) the resulting $T_e$ according to formula [8], which is implemented in LUT_3 (see FIG. 6):

$$T_s = T_{s0} + \Delta T_{s1} + \Delta T_{s2} \quad [8]$$

Finally, according to a preferred embodiment of the present invention, the estimating of the minimum temperature of a heating element ($T_{e,min}$) is obtained from said estimation of the substrate temperature ($T_s$) and from said measurement of the temperature of the drum ($T_d$) by resistive potentiometric dividing as illustrated in FIG. 13 which precisely is an equivalent circuit for the updating of Te from the temperatures $T_s$ and $T_d$. Herefrom, formula [9] results $$T_e = [(T_s - T_d) \times (R_{ed})/(R_{ed} + R_{es})] + T_d \quad [9]$$

According to the present invention, this model is preferably "synchronised" (by updating the drum, substrate and heat sink temperatures) at the beginning of every print pass, so avoiding accumulation of errors due to possible imperfections of the model.

Figure 14:
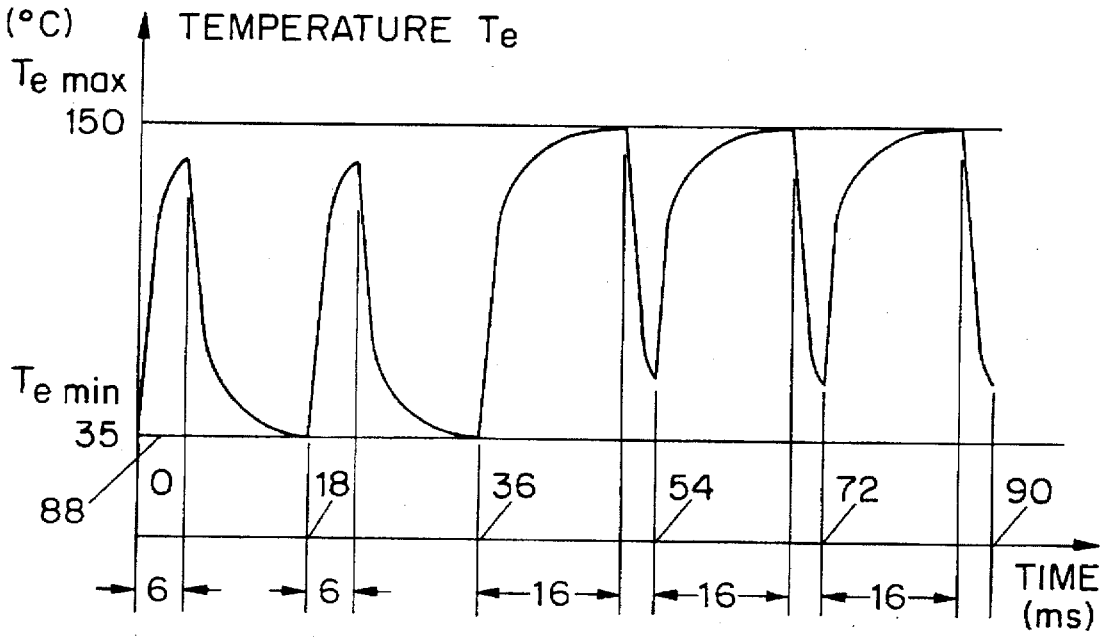
FIG. 14 is a survey of some different temperature profiles Te.

With reference to FIG. 14, which is a survey of some different temperature profiles $T_e$, it has to be emphasized that the solution of the present invention is especially oriented towards the temperature of the heating elements just before a printing line is started, indicated by $T_{e,min}$ (referal 88). The estimating of the minimum temperature of the heating elements ($T_{e,min}$) is obtained from the estimation of the substrate temperature ($T_s$) and from the measurement of the temperature of the drum ($T_d$) by resistive potentiometric dividing according to the formula $$T_{e,min} = p \cdot [(T_s - T_d) \times (R_{ed})/(R_{ed} + R_{es}) + T_d] \quad [10]$$

wherein $R_{ed}$ is the thermal resistance between the heating element and the printing drum, $R_{es}$ is the thermal resistance between the heating element and the substrate, and p is a proportionality factor.

As a result of the description given hereabove, in one embodiment of the present invention, provided is a method for printing an image using a thermal printing system, comprising a step of estimating the temperature of the heating elements of a thermal head, said process comprising the steps of measuring the thermal head voltage ($V_{TH}$) before start of an image; initiating an initial value ($T_{s0}$) for the temperature of the substrate; counting the number ($N_h$) of activated heating elements; measuring the temperature ($T_d$) of the drum and the temperature ($T_h$) of the heatsink; transferring the number ($N_h$) of activated heating elements and the measured temperature values $T_d$ and $T_h$ to a temperature estimating device; retrieving a first change ($\Delta T_{s1}$) in the temperature of the substrate as a function of the temperature values $T_d$ and $T_s$ and of the number ($N_h$) of activated heating elements from a first LUT-table; retrieving a second change ($\Delta T_{s2}$) in the temperature of the substrate as a function of the temperature values $T_s$ and $T_h$ from a second LUT-table; adding said first change ($\Delta T_{s1}$) and said second change ($\Delta T_{s2}$) in the temperature of the substrate and the initial value of the temperature of the substrate ($T_{s0}$); temporary storing the adding result ($T_s$) in a register means; feeding back the adding result ($T_s$) to an input of said first LUT-table and to an input of said second LUT-table; retrieving the minimum temperature of the heating elements ($T_{e,min}$) of a thermal head as a function of the temperature values $T_s$ and $T_d$ from a third LUT-table storing an apt linear relation; storing the minimum temperature of the heating elements ($T_{e,min}$) in a memory means (MEM_$T_e$); updating the contents of all above mentioned means each time a line is recorded; making the value $T_{e,min}$ available to any printing correction system.

In order to illustrate one of the benefices of the present invention, it first has to be emphasised that regarding the estimate of $T_e$, the conventional calculations may be rather extensive. Even for a very simple circuit, as e.g. in FIG. 9, the time dependent transients have to be expressed exponentially and take quite a large calculation time.

For example, the resulting temperature T is calculated as the result of first a heat storage, and second, a heat loss, wherein the heat storage causes a temperature rise equivalent to the voltage $V_1$ in the charging cycle for the equivalent circuit shown in FIG. 9 and the heat loss causes a temperature decay equivalent to the voltage $V_2$ in the discharging cycle for the same equivalent circuit shown in FIG. 9.

$$T \propto V_1 - V_2 = V_{10} \times (1 - e^{-\alpha t}) - V_{20} \times e^{-\alpha t} \quad [11]$$

wherein $\alpha$ is a function of $R_1$, $R_2$ and $C_1$, precisely $\alpha = (R_1 + R_2)/(R_1 R_2 C)$.

A quadratic approximate expansion equation of T, indicated as T', may be introduced as follows:

$$T \approx T' = a(\Delta t)^2 + b(\Delta t) + c \quad [12]$$

wherein a, b and c are coefficients to be determined by taking into account the initial conditions, and $\Delta t$ is an infinitely small time, approximated by the strobe pulse width, as the strobe pulse width is of the order of μsec, while the time for the temperature to be measured is more than one second.

This approximate calculation method yet reduces the calculation time, but it still requires a great effort.

However, the use of a specific LUT embodiment (cfr. FIG. 6) according to the present invention brings a great additional advantage. While such a table consists of an ordered pair of input and output values, the LUT is very efficient in performing repetitive operations and can save a significant amount of time. By doing this, the present invention provides a fast and accurate estimate for the temperature.

Figure 15:
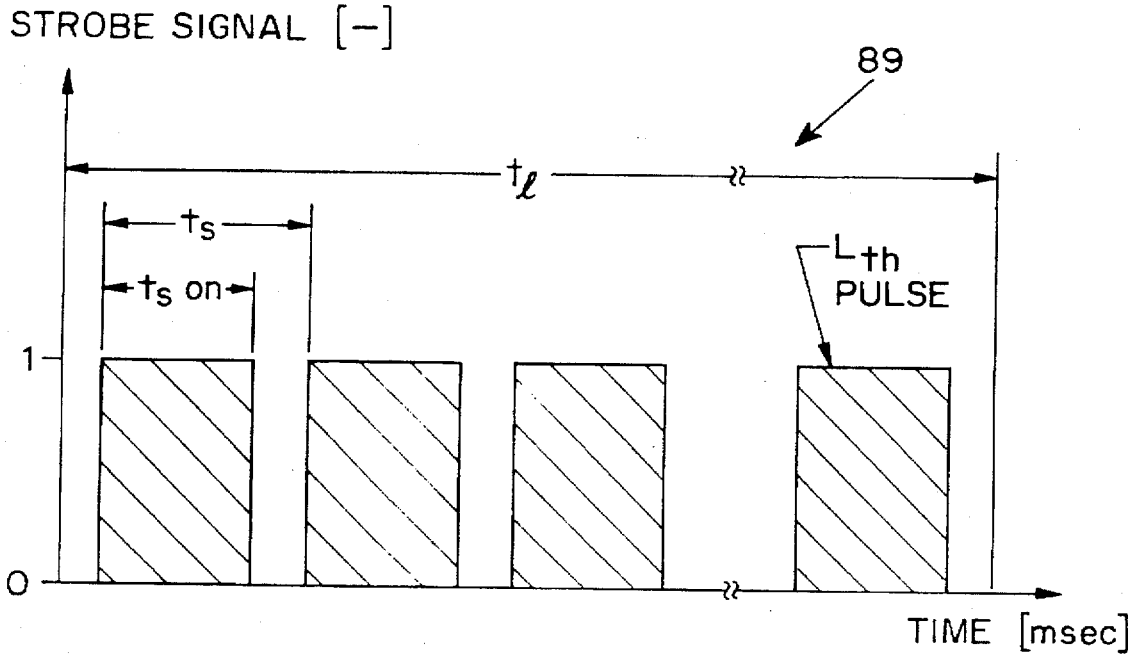
FIG. 15 is a chart illustrating principaly the activating strobe pulses of a heating element with an exemplary duty cycle.

In a thermal sublimation printer or thermal sublimation printing method according to the preceding description, the activation of the heating elements is preferably executed duty cycled pulsely in a special manner, further referred to as "duty cycled pulsing". This is illustrated in FIG. 15 showing the current pulses applied to a heating element and indicated by referal 89. The repetition strobe period ($t_s$) consists of one heating cycle ($t_{son}$) and one cooling cycle ($t_s-t_{son}$) as indicated in the same FIG. 15. The strobe pulse width ($t_{son}$) is the time an enable strobesignal is on. The duty cycle of a heating element is the ratio of the pulse width ($t_{son}$) to the repetition strobe period ($t_s$). Supposing that the maximal number of obtainable density values attains L levels, the line time ($t_1$) is divided in a number (L) of strobe pulses each with repetition strobe periods $t_s$ as indicated. In the case of e.g. 1024 density values (according to a 10-bits format of the corresponding electrical image signal values), the maximal diffusion time would be reached after 1024 sequential strobe periods.

In the case of activation by duty cycled pulsing, it may be clear that the power quantity, up to now indicated by the symbol $P_e$ (e.g. in formula 6) has to be interpreted as being a time averaged power $P_{e,ave}$, defined by $$P_{e,ave}=P_e\cdot(t_{son}/t_s) \quad [13]$$

While the invention has been described with reference to a preferred embodiment, it is to be clearly understood by those skilled in the art that the invention is not limited thereto. For example, the thermal masses can be represented by inductances, the temperatures can be represented by currents, and the power applied to the thermal print element can be represented by a voltage. As another example, the thermal model (or an equivalent electrical model) may be represented in software (wherein the various thermal parameters as temperatures, thermal resistances and thermal capacitances may be represented by corresponding process variables and may be stored in suitable registers). Therefore, the scope of the invention is to be interpreted in conjunction with the appended claims.

The present invention clearly can be applied in the case of thermal sublimation printing (TSP), dye diffusion thermal transfer (D2T2), thermal dye transfer, thermal transfer printing, direct thermal printing, etc.

We claim:

1. A thermal printing apparatus comprising:

(a) a printer comprising:

(i) a dye donor member having one or more dye frames and an acceptor member on a receiving sheet secured to a rotatable printing drum, where said acceptor receives dyes from said dye frames;

(ii) a thermal head having at least a plurality of heating elements, a heating element substrate and a heatsink mount;

(b) first controlling means for driving synchronized movements of said donor member and said acceptor member along respective paths relative to said thermal head such that as said thermal head is activated in accordance with image data, dye from said dye frame is transferred to said receiver to form an image thereon;

(c) second controlling means for supplying line by line an activating signal corresponding to said image data to activate said heating elements;

(d) means for counting a number ($N_h$) of activated heating elements within periodic observation intervals, said intervals not exceeding a time necessary to print a line on said acceptor member;

(e) means for measuring a temperature ($T_d$) of said drum and a temperature ($T_h$) of said heatsink within said periodic observation intervals;

(f) means for digitizing said measured temperature values ($T_d$ and $T_h$) of said drum and of said heatsink within said periodic observation intervals;

(g) means for transferring said number ($N_h$) of activated heating elements and said digitized temperature values ($T_d$ and $T_h$) within said periodic observation intervals;

(h) a device for estimating said temperature ($T_e$) of said heating elements based on said values of $N_h$, $T_d$ and $T_h$, wherein said estimated temperature ($T_e$) of said heating elements comprises a minimum temperature ($T_{e,min}$) of said heating elements just before a printing line is started;

(i) memory means (MEM_$T_e$) for storing said estimate of the temperature ($T_e$) of said heating elements; and (j) means for operating said printer to adjust the applied energy to said heating elements of said thermal head as a function of said estimated temperature ($T_e$) of said heating elements and of the required temperature of said heating elements.

2. The thermal printing system according to claim 1, further comprising means for activating the heating elements in pulsed fashion (89).

3. The apparatus according to claim 1 comprising means for estimating a temperature ($T_s$) of said substrate, further comprising:

(a) means for measuring temperatures of said drum ($T_d$) and of said heatsink ($T_h$); and (b) means for adding at periodic observation intervals a temperature change in said substrate ($\Delta T_s$), wherein said temperature change $\Delta T_s$ is calculated from the difference between the total heat generated by all activated heating elements cumulatively stored in said thermal head during the sequential heating times, and the total heat lost during said observation intervals as a consequence of the energy unloaded from said substrate to said heatsink and to said drum.

4. The apparatus according to claim 3 comprising a means for linearly approximating both said total heat generated and said total heat lost over small intervals of time.

5. The apparatus according to claim 1 comprising a means for estimating said minimum temperature ($T_{e,min}$) of said heating elements from estimation of said substrate temperature ($T_s$) and from measurement of said drum temperature ($T_d$) by resistive potentiometric dividing according to the formula $$(T_{e,min})=p\times[(T_s-T_d)\times(R_{ed})/(R_{ed}+R_{es})+T_d],$$

wherein $R_{ed}$ is a thermal resistance between said heating element and said drum, $R_{es}$ is a thermal resistance between said heating element and said substrate, and p is a proportionality factor.

6. In the apparatus according to claim 1, a means for estimating said temperature ($T_e$) of said heating elements comprising:

(a) means for measuring a thermal head voltage ($V_{TH}$) before the start of an image;

(b) means for initiating said initial value ($T_{s0}$) for said temperature ($T_s$) of said substrate;

(c) means for counting said number ($N_h$) of activated heating elements;

(d) means for measuring said temperature ($T_d$) of said drum and said temperature ($T_h$) of said heatsink;

(e) means for transferring said number ($N_h$) of activated heating elements and said measured temperature values $T_d$ and $T_h$ to said temperature estimating device;

(f) means for retrieving, from a first look-up table, a first change ($\Delta T_{s1}$) in temperature ($T_s$) of said substrate as a function of said temperature values $T_d$ and $T_s$ and of said number ($N_h$) of activated heating elements;

(g) means for retrieving, from a second look-up table, a second change ($\Delta T_{s2}$) in said temperature ($T_s$) of said substrate as a function of said temperature values $T_s$ and $T_h$;

(h) means for adding said first change ($\Delta T_{s1}$) and said second change ($\Delta T_{s2}$) in said temperature ($T_s$) of said substrate and of said temperature value ($T_s$) of said substrate to derive a new value for said temperature ($T_s$) of said substrate;

(i) means for storing said new value for said temperature ($T_s$) of said substrate;

(j) means for using said new value for said temperature ($T_s$) as an input to said first and second look-up tables for determining said first and second changes ($\Delta T_{s2}$ and $\Delta T_{s2}$) in said temperature ($T_s$) of said substrate;

(k) means for using a third look-up table for determining said minimum temperature ($T_{e,min}$) of said heating elements as a function of said temperature values $T_s$ and $T_d$;

(l) means for storing said minimum temperature ($T_{e,min}$) of said heating elements in said memory means (MEM_$T_e$);

(m) means for updating the values of all above mentioned means each time a line is recorded; and (n) means for making said minimum temperature value ($T_{e,min}$) of said heating elements available to a printing correction system.

7. In a thermal printing apparatus having thermal heating elements contained in a thermal head, means for estimating a temperature ($T_e$) of said heating elements comprising a microprocessor, wherein said microprocessor comprises:

(a) initialization means for storing an initial value ($T_{s0}$) as the temperature ($T_s$) of said substrate;

(b) a first look-up table for determining first values representing a first change ($\Delta T_{s1}$) in said substrate temperature value ($T_s$) as a function of a temperature value ($T_d$) of a printing drum, said substrate temperature value ($T_s$), and a number ($N_h$) of activated heating elements;

(c) a second look-up table for determining second values representing a second change ($\Delta T_{s2}$) in said substrate temperature value ($T_s$) as a function of said substrate temperature value ($T_s$), and a temperature value ($T_h$) of a heatsink mount;

(d) means for adding said first and second values ($\Delta T_{s1}$ and $\Delta T_{s2}$) to said stored substrate temperature value ($T_{s0}$) line to derive a new value for said substrate temperature ($T_s$);

(e) means for storing said new value for said substrate temperature ($T_s$);

(f) means for using said new value for said substrate temperature ($T_s$) as an input to said first and second look-up tables for determining new values for said first and second changes ($\Delta T_{s2}$ and $\Delta T_{s2}$) in said substrate temperature value ($T_s$);

(g) a third look-up table for determining a minimum temperature ($T_{e,min}$) of said heating elements as a function of said temperature values $T_s$ and $T_d$;

(h) memory means (MEM_$T_e$) for storing a value corresponding to said temperature ($T_e$) of said heating elements, wherein said temperature ($T_e$) of said heating elements comprises said minimum temperature ($T_{e,min}$) of said heating elements just before a printing line is started; and (i) means for updating the values of all above mentioned means.

8. In a thermal printing apparatus having thermal heating elements contained in a thermal head, means for estimating a temperature ($T_e$) of said heating elements comprising an equivalent electrical circuit, said electrical circuit comprising:

(a) electrical capacitors representing thermal capacitances of a heating element substrate, a printing drum, a heatsink mount, ambient air and said heating elements;

(b) electrical resistors representing thermal resistances of said heating element substrate, said printing drum, said heatsink mount, said ambient air and said heating elements;

(c) means for taking into account the heat losses in said drum, a donor member, and an acceptor member;

(d) means for taking into account the heat loss between said heatsink mount and said ambient air; and (e) and means for periodically updating said electrical circuit.

9. The apparatus according to claim 8, comprising activating the heating elements in pulsed fashion (89).

10. In a thermal printing apparatus, a method for estimating a temperature ($T_s$) of a thermal heating element substrate by:

(a) measuring temperatures of a thermal drum ($T_d$) and of a heatsink mount ($T_h$); and (b) adding, at periodic observation intervals, a temperature change in said substrate ($\Delta T_s$), wherein said temperature change $\Delta T_s$ is calculated from the difference between the total heat generated by all activated heating elements cumulatively stored in the thermal head during the sequential heating times, and the total heat lost during said observation intervals as a consequence of the energy unloaded from said substrate to said heatsink and to said drum.

11. The method according to claim 10 comprising a step of linearly approximating both said total heat generated and said total heat lost over small intervals of time.

12. The method according to claim 10 comprising a step of estimating a minimum temperature of said heating elements ($T_{e,min}$) from estimation of said substrate temperature ($T_s$) and from said measurement of drum temperature ($T_d$) by resistive potentiometric dividing according to the formula $$(T_{e,min})=p\times[(Ts-T_d)\times(R_{ed})/(R_{ed}+R_{es})+T_d],$$

wherein $R_{ed}$ is a thermal resistance between said heating element and said printing drum, $R_{es}$ is a thermal resistance between said heating element and said substrate, and p is the a proportionality factor.

13. The method according to claim 10 comprising steps of:

(a) measuring a thermal head voltage ($V_{TH}$) before the start of an image;

(b) initiating said initial value ($T_{s0}$) for said temperature ($T_s$) of said substrate;

(c) counting said number ($N_h$) of activated heating elements;

(d) measuring said temperature ($T_d$) of said drum and said temperature ($T_h$) of said heatsink;

(e) transferring said number ($N_h$) of activated heating elements and said measured temperature values $T_d$ and $T_h$ to said temperature estimating device;

(f) retrieving, from a first look-up table, a first change ($\Delta T_{s1}$) in said temperature ($T_s$) of said substrate as a function of said temperature values $T_d$ and $T_s$ and of said number ($N_h$) of activated heating elements;

(g) retrieving, from a second look-up table, a second change ($\Delta T_{s2}$) in said temperature of said substrate as a function of said temperature values $T_s$ and $T_h$;

(h) adding said first change ($\Delta T_{s1}$) and said second change ($\Delta T_{s2}$) in said temperature ($T_s$) of said substrate and said temperature value ($T_s$) of said substrate to derive a new value for said temperature ($T_s$) of said substrate;

(i) storing said new value for said temperature ($T_s$) of said substrate;

(j) using said new value for said temperature ($T_s$) as an input to said first and second look-up tables for determining said first and second changes ($\Delta T_{s2}$ and $\Delta T_{s2}$) in said temperature ($T_s$) of said substrate;

(k) using a third look-up table for determining said minimum temperature ($T_{e,min}$) of said heating elements as a function of said temperature values $T_s$ and $T_d$;

(l) storing said minimum temperature ($T_{e,min}$) of said heating elements in said memory means (MEM_$T_e$);

(m) updating the values of all above mentioned means each time a line is recorded; and (n) making said minimum temperature value ($T_{e,min}$) of said heating elements available to a printing correction system.

* * * * *

UNITED STATES PATENT AND TRADEMARK OFFICE

CERTIFICATE OF CORRECTION

PATENT NO. : 5,664,893

DATED : September 9, 1997

INVENTOR(S) : Meeussen et al.

It is certified that error appears in the above-identified patent and that said Letters Patent is hereby corrected as shown below:

Column 15, line 22, "$\Delta T_{s2}$ and" should read --$\Delta T_{s1}$ and--;

Column 15, line 63, "$\Delta T_{s2}$ and" should read --$\Delta T_{s1}$ and--;

Column 18, line 3, "$\Delta T_{s2}$ and" should read --$\Delta T_{s1}$ and--.

Signed and Sealed this

Nineteenth Day of May, 1998

Bruce Lehman

*Attest:*

BRUCE LEHMAN

*Attesting Officer*

*Commissioner of Patents and Trademarks*